US007963835B2

(12) United States Patent
Jessop et al.

(10) Patent No.: US 7,963,835 B2
(45) Date of Patent: Jun. 21, 2011

(54) GNOSI GAMES

(76) Inventors: Louis G. Jessop, South Jordan, UT (US); Paul D. Noble, West Jordan, UT (US); Daniel E. Loveridge, Sandy, UT (US)

( * ) Notice: Subject to any disclaimer, the term of this patent is extended or adjusted under 35 U.S.C. 154(b) by 1105 days.

(21) Appl. No.: 11/686,181

(22) Filed: Mar. 14, 2007

(65) Prior Publication Data

US 2008/0009346 A1 Jan. 10, 2008

Related U.S. Application Data

(63) Continuation-in-part of application No. 11/456,179, filed on Jul. 7, 2006, now Pat. No. 7,677,967.

(51) Int. Cl.
*A63F 13/00* (2006.01)

(52) U.S. Cl. ..... 463/9; 434/323

(58) Field of Classification Search ..... 463/9; 434/236
See application file for complete search history.

(56) References Cited

U.S. PATENT DOCUMENTS

2007/0238079 A1* 10/2007 Harrison ..... 434/236

* cited by examiner

*Primary Examiner* — Melba Bumgarner
*Assistant Examiner* — Thomas H Henry
(74) *Attorney, Agent, or Firm* — Workman Nydegger

(57) ABSTRACT

Educational materials are presented in the format of games such as role-playing where participants progress through game storylines within a game environment. Each game participant is assigned a game character having attributes that can be modified as the character progresses through the game storylines. The character encounters challenges and participates in game actions that require the participant to answer questions corresponding to educational materials that are sometimes contextually unrelated to the game storylines. The character also passes through portals to different worlds that are thematically related to different learning materials and where different learning experiences and testing occurs.

22 Claims, 3 Drawing Sheets

GNOSI GAMES

CROSS-REFERENCE TO RELATED APPLICATIONS

This application is a continuation-in-part of U.S. patent application Ser. No. 11/456,179, filed Jul. 7, 2006, and entitled "BATTLE SCHOOL". The foregoing application is incorporated herein by reference in its entirety.

BACKGROUND

The present invention relates to games, as well as methods, systems, and computer-program products for promoting educational interests and social development through the use of games.

While the educational and gaming industries often find themselves at odds, competing for the time and attention of the younger generation, it will be appreciated that there are many opportunities for these industries to cooperatively work together in the development of new and exciting educational games. This is particularly true in view of technological advances that have been made with computing and communications devices that are heavily leveraged by the educational and gaming industries.

Improvements in technology have also reduced the manufacturing costs to the point that it is now relatively affordable for every household to own one or more computing devices. The affordability of manufacturing new and exciting technology is also readily apparent in the sheer volume of gaming and multimedia consoles that are manufactured solely for entertainment purposes.

While it can certainly be argued that technology has enhanced our educational and entertainment opportunities, it can also be argued that the excessive abundance of new and exciting technologies in the entertainment industry has actually had a negative impact on the educational and social development of our youth. For example, many youth spend more time watching television, surfing the Internet and playing video games than they spend in school, playing outside or working.

This new socio-technological environment that children are now exposed to provides many obstacles and challenges to their learning and social development. Among other things, the ever limited attention span of our youth appears to shrink even more in the presence of new and exciting movies, games and other entertainment that are continually being presented in increasingly more affordable and convenient ways.

The difficulty for students to maintain the appropriate level of concentration, which is arguably required to learn, is particularly noticeable when the students are required to learn from traditional and, arguably, less stimulating teaching methods.

Technological advances have also had a significant influence on the manner in which we communicate. For example, it is now typical to use computing devices to communicate through email, telephone text-messaging, instant messaging and so forth. However, while computing devices can improve the ease and convenience of communicating, the increased use of computing devices for communication can also have a negative impact on the development of certain social skills. In particular, the increased use of computing devices to communicate can reduce the duration and frequency of face-to-face experiences that are sometimes necessary to develop and learn fundamental social skills. In fact, it is somewhat ironic that while computers have drastically improved the convenience of communicating with distant peoples in remote places, they have also created a crutch and refuge for further isolating the socially challenged people that we live with in our own communities.

The Internet, the television and personal gaming consoles have also reduced the demand for social interaction since many people find electronic entertainment to be a convenient and adequate substitution for social stimulation.

Notwithstanding these increasingly noticeable and grievous side effects of certain technologies, particularly within the entertainment industry, there does not appear to be any immediate end in sight. In fact, to the contrary, all signs appear to indicate that the entertainment industry will continue making new products for feeding an insatiable demand for convenient and exciting entertainment.

In view of the foregoing, there is clearly a need to provide new and exciting teaching techniques, as well as opportunities for social interaction, which are capable of competing with the entertainment industry. It would also be desirable to provide new educational tools and techniques that utilize the technological advances that have been developed in the gaming industry and that utilize the technological experiences and skills possessed by children that are exposed to technologically advanced environments and devices.

BRIEF SUMMARY

This Summary is intended to introduce a selection of concepts in a simplified form that are further described in the Detailed Description below. This Summary is not intended to identify the key features or essential features of the claimed subject matter, nor is it intended to be used as an aid in determining the scope of the claimed subject matter.

As described below, embodiments of the present invention include various new and unique methods, systems and computer-program products for promoting learning, social development and other educational interests through the use of games, such as, for example, role-playing games and even more particularly, electronic role-playing type games.

In some embodiments, educational materials are presented in the format of a game where participants socially interact within a game environment. The game environment can be modeled after another environment that is familiar to the game participants, such as a school environment, a workplace, a home environment or any other environment. The environment can also be a fantasy environment, which is somewhat detached from reality, or a modeled learning environment that specifically relates to a particular educational time period, subject or other genre.

Each game participant is assigned a game character from a plurality of characters that have unique attributes (e.g., strengths, weaknesses, and other characteristics). In some embodiments, the characters are dynamic inasmuch as their defined attributes can be developed or otherwise modified over time, such as, for example, as the character progresses through a storyline of the game or as the character demonstrates mastery of certain learning materials.

The assignment of a character to a game participant is based on any combination of factors, such as the participant's affinity for a particular character type, based on a strategy, based on a class requirement, rules, and so forth. To facilitate a broad selection of characters, the characters can be modeled after different personality types, interests, job descriptions, roles, demographics, historic personas and/or other factors.

In some embodiments, the participants are exposed to a storyline within a hypothetical environment in which their character must perform a feat, complete a quest, master a particular skill, demonstrate mastery of a particular knowledge base, engage in battle or participate in another game activity or action.

During the game, the participants are also exposed to educational materials that must be mastered in order for their character to progress thru the storyline or to obtain a desired reward or result within the game environment. The knowledge caches or educational materials exposed to the game participants can vary to accommodate virtually any need or preference. In some embodiments, the educational materials exposed to the participants are thematic and based on a particular time period, subject matter, or historic event. In such embodiments, the game play can be modeled after the particular themed materials being learned.

Accordingly, it will be appreciated that in some embodiments, the storyline and game actions are contextually unrelated to educational materials, while in other embodiments, the game actions and storylines are contextually related to educational materials. The degree in which the storyline and game actions correspond to educational materials can vary to accommodate different needs and preferences.

When a participant shows mastery of a particular educational material, the participant's character can be provided a reward, such as advancement of a character skill level or another character metric. A reward can also be a desired movement on a game board, when the game is played on a board. In some embodiments, the earned rewards also correspond to domination of a particular world territory or obtaining a token, weapon, bullion, or another award.

In some embodiments, the participant's character must recruit and work with other characters that are assigned to different game participants in order to successfully and collaboratively overcome a challenge and to obtain a desired result within the game hypothetical environment. For example, in some embodiments, a combination of different strengths, attributes, and characteristics of a plurality of different characters must be cooperatively applied to a particular situation in order to achieve a desired result within the game.

By requiring cooperation of different characters within the game and by carefully modeling a diverse set of game characters for the participants to select from, it is possible to encourage and promote social groupings of virtually any desired combination. Various profiling and psychological analysis can also be used to refine character descriptions and attributes so that the characters will closely correlate with the personalities and traits of disparate participants.

In some embodiments, the participants participate in hypothetical battles within the game environment, wherein the success of a particular attack or defensive action during a battle sequence is determined by a combination of the assigned strengths, weaknesses and attributes of the participants' character, the type of question asked and the participants' personal mastery of the educational materials.

In some embodiments, a participant's assigned character initiates an attack on another participant's character within the game environment by asking a question corresponding to particular educational material. The difficulty or mastery level associated with a question corresponds to a type of weapon or shield that is used in the game environment and the potential damage or success of the attack. The defender defends against or is shielded from the damage of an attack by answering the presented question correctly. Different metrics can be used to determine how accurately a question is answered and how much corresponding damage is suffered, if any.

In some battles, twitch gaming sequences can be interleaved with the melee of questions and answers to provide an even more interactive and stimulating or complete gaming experience. In some embodiments, each battle involves at least some twitch gaming sequences, requiring mastery of hand and eye coordination. In other embodiments, the twitch gaming sequences are optional or only incorporated as rewards for mastery of particular knowledge bases, as evinced by success in the question and answer melee attacks.

The participant characters also encounter and use articles, tools and other items within the hypothetical game environment, each of which has its own unique and predetermined characteristics, attributes and capabilities. This can be particularly useful for embodiments that are modeled after thematic events or other educational subject matter. In particular, the participant can learn about particular, currency, geography, buildings, people and articles of historic significance by being exposed to these things within the game environment. For games modeled after workplace environments, the articles and tools encountered can be the articles and tools that have a practical application for the training of the participant in a particular work related skill.

In some embodiments, the characters within the game have opportunities to barter, buy and sell the items that have been acquired within the game and that may be required to accomplish certain feats within the game.

Inasmuch as the successful completion of a task, the acquisition of an item, the progress within a storyline and the development of a character directly correspond to the successful mastery of certain educational materials, corresponding reports and metric evaluations of a participant's knowledge and skill sets can similarly be obtained by directly evaluating the measured progress, development and possessions of the participant's storyline character(s). In some embodiments, mastery of certain skill sets or knowledge bases also directly corresponds with domination and ownership of land and other possessions within a game storyline.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
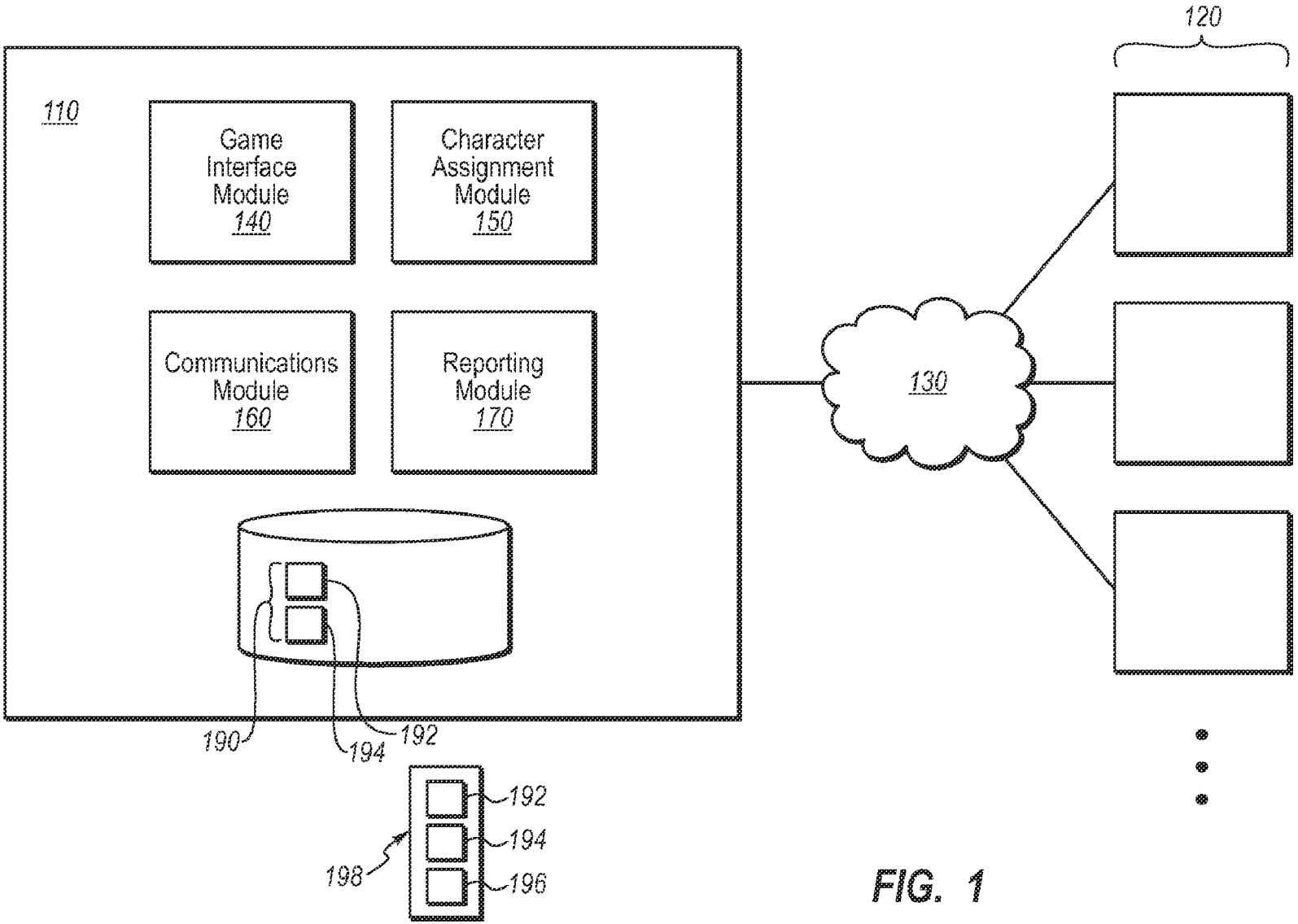
FIG. 1 illustrates one example of a computing embodiment that can be used to practice at least some aspects of the present invention.

The present invention relates to games, as well as methods, systems and computer-program products for providing and using the games to promote education and social development.

Although the use of computers are not necessary for every embodiment of the present invention, some embodiments of the present invention do comprise one or more computers, which can include gaming consoles, and which include the various computer hardware necessary to implement the computerized methods of the invention, and particularly those discussed below with regard to a client system and third party computing systems.

Certain embodiments within the scope of the present invention also include computer-readable media for carrying or having computer-executable instructions and data structures stored thereon. The computer-executable instructions can include computer interfaces, games, multimedia content and modules for implementing any part or the entirety of the different claimed embodiments.

As described herein, "computer-executable instructions" comprise instructions and data which cause a general purpose computer, special purpose computer, or special purpose processing device to perform a certain function or group of functions. Computer-executable instructions are also sometimes referred to herein as modules. Many of the computer-executable instructions are also embodied as applets, scripts and executables that can be transmitted between the computing systems described below.

The computer-readable media containing the computer-executable instructions or modules include any available media that can be accessed by a general purpose or special purpose computer, such as, but not limited to gaming consoles. By way of example, and not limitation, such computer-readable media can comprise RAM, ROM, EEPROM, CD-ROM or other optical disk storage, magnetic disk storage or other magnetic storage devices, or any other medium, such as gaming console media, which can be used to carry or store desired program code means in the form of computer-executable instructions or data structures and which can be accessed by a general purpose or special purpose computer.

When information is transferred or provided over a network or another communications connection (either hardwired, wireless, or a combination of hardwired or wireless) to a computer, the computer properly views the connection as a computer-readable transmission medium. In some embodiments, the term computer-readable media include computer-readable transmission media.

To help facilitate a correct understanding and interpretation of the scope of the claims and application, certain additional terms will also be defined.

The term "Gnosi Games" refers to knowledge games, such as those described in this paper, which can be used to test and provide knowledge to the game participants.

The term "attribute", as used in reference to character attributes, is defined as any combination of one or more characteristics of the game characters, including, but not limited to an attack attribute, a defense attribute, a skill level or encumbrance, a profile, a title, a resource, a power, a speed, an agility, a special knowledge, a character designation, a classification, hit points, status, energy, and any other identifiable characteristic.

The term "attack attribute" and "defense attribute" correspond specifically to attributes that affect an outcome of a battle sequence or action involving at least one game character.

The term "battle" generally corresponds to a game action in which a character receives an attack and/or initiates an attack that involves another character, game entity or object. A "battle" also typically includes, although not necessarily, a character defending against an attack. In many embodiments, an attack is performed by the presentation of a question to a game participant by another game participant or moderator associated with the attacking character, entity or object in the game environment.

The attack attributes, referenced above, generally correspond to combinations of weapons, spells, poisons, characteristics and other possessions associated with character in the game environment that can be used to inflict damage to another object, entity or character within the game environment. The defense attributes, on the other hand, generally correspond to combinations of shields, protective items, spells, characteristics and other possessions associated with a character in the game environment and that can be used to avoid, protect against or deflect an attack within the game environment.

The term "possessions" is generally used in reference to any combination of weapons, clothing, items, objects, currency, spells, food, and even other entities or characters that are controlled or possessed by a character within the game environment.

The term "game environment" generally refers to a fictitious environment in which the game participants' characters participate in game actions, progress through a storyline and interact with other characters, entities and objects. In some embodiments, the game environment is modeled after an environment that is familiar to the game participants. The game environment is sometimes only a conceptual or hypothetical environment described by a moderator or text. In other instances the game environment also includes physical models and objects, graphical displays, game boards, cards, dice, pictures and so forth. The game environment defines the setting in which the game participants' characters interact, progress and develop. In some instances, storylines are used to further define the game environment. The rules for the interactions, progressions and development of characters within the game environment are recited in any combination of printed text (e.g., books, manuals, charts, and so forth) and computer interfaces.

The term "portal" refers to an actual or theoretical door or gateway to a particular game environment. In practice, the portals can lead to different worlds, locations within a world and different periods of time. In some embodiments, one or more portals are presented for enabling access to special gaming environments that are contextually related or unrelated to a particular skill set or educational theme. Passage through a portal can, although not necessarily, change the participants character to correspond to the new environment where the character exits the portal. Portals can be presented in both the computing and non-computing environments. In some embodiments, special permissions or acquisitions are necessary prior to entering a portal or entering a particular game environment through a portal, such as, but not limited to mastery of a particular subject matter or a measured progression through the game.

The term "twitch" or "twitch gaming sequence", which is well known to those of ordinary skill in the art of computing games, refers to the type of joystick, keyboard, or controller related activity in which a game responds to user input received through a controller. In some embodiments of the present invention, character movements and attacks are controlled through twitch gaming sequences.

While the game environment and storylines of the present invention can be utilized without the use of a computer, many embodiments of the invention do use a computing system to present the game environment and storyline within an interactive computer game. Within the computing based embodiments, the computers can be used to perform profiling, assigning of characters to participants, and reporting of the participants' mastery of educational materials.

One suitable computing environment 100 for implementing aspects of the present invention will now be described with reference to FIG. 1.

Computing Environment

As shown in FIG. 1, the computing environment 100 includes a client system 110, and one or more remote systems 120, which can include any combination of other client systems, proxy servers, and server systems.

Although the term "server" and "client" can denote fixed relationship between computing systems in which the server provides services to the client, it will be appreciated that the present application does not require such a formal or fixed relationship. Instead, the terms 'server' and 'client' are used in this application for convenience of description, inasmuch as all of the computing systems referred to in this application can operate at disparate times as a traditional server as well as a traditional client.

It will also be appreciated that the client and the remote third party systems can include any combination of stand-alone computing systems, gaming consoles, and distributed systems having a plurality of individual computing systems that are connected through a communication link, such as communication link 130, which can include any combination of physical and wireless communication paths. In some embodiments, the communication link 130 includes at least the Internet.

Inasmuch as the client and the remote third party systems can each include any combination of stand-alone computing systems, gaming consoles, and distributed systems, the illustrated modules 140, 150, 160, 170 that are shown to be located within the client system can actually be distributed among any combination of stand-alone computing systems, gaming consoles, and distributed systems.

Each of these computing modules, including the game interface module 140, the character assignment interface 150, the communications module 160 and the reporting module 170 will now be described in more detail.

The game interface module 140 includes sufficient computer-executable instructions for presenting multimedia content, network interfaces, menus, text, and other content at a display associated with the client system 110 and corresponding to the game environment, the storyline, and character interactions. The game interface module 140 is also configured, in some instances, to present multimedia content to the user for review and in the form of a question presented in response to a game action.

In some instances, the game interface module 140 also includes computer-executable instructions for customizing or building a game environment and storyline. The game interface module 140 also includes sufficient computer-executable instructions for presenting interfaces that are configured for receiving answers to presented questions and other input from the user.

The character assignment module 150 includes sufficient computer-executable instructions for presenting a plurality of characters to the user and for assigning one or more of the characters to the user. In some instances, the assignment is based on a user selection and a user affinity for a character. In other instances, the assignment is controlled by matching a profile of the user with a profile of the characters. In these instances, the character assignment module 150 also includes sufficient computer-executable instructions for profiling the user and matching the profile of the user, or at least one attribute of the user, to the profile of a character, or at least one attribute of a character.

The character assignment module 150 also includes sufficient computer-executable instructions for developing and customizing characters and their attributes.

The communications module 160 includes sufficient computer-executable instructions for coordinating communications between the various modules 140, 150, 160, 170 and between the client system 110 and the one or more remote systems 120. The communications module 160 includes sufficient computer-executable instructions for presenting information generated by the various modules (140, 150, 160 and 170) to a user through one or more user interfaces.

The reporting module 170 includes sufficient computer-executable instructions for evaluating and assessing a user's mastery of educational materials and for generating a grade or score corresponding to the user's mastery of the educational materials. In some instances, the reporting module 170 assesses a user's mastery of educational materials based on a predetermined combination of the progress, possessions, rewards, and other attributes of the user's character within the game environment. This is possible, inasmuch as the progress, possessions, rewards and attributes of a character within the game environment is dependent upon a user's answers to questions about the educational materials.

FIG. 1 also illustrates that the client 110 can include storage 180 for storing the computer-executable instructions that enable the computing functionality implemented by the client as well as the content 190 used by the client 110. Some of the content 190 maintained or utilized by the client includes rules 192 regarding participation in a game and rules for assigning characters. The data can also include character files 194 that describe the characters, their attributes, their status, and any other corresponding multimedia files corresponding to the characters. Other data corresponding to the game environment and storylines can also be stored by the client.

It will be appreciated that the client storage 118 can include any combination of volatile and non-volatile memory which is stored locally at the client system or that is remotely located from the client system 110, such as, for example, at a remote system 120, or on disk.

In some embodiments, the storage accessible for use during a game includes databases of information corresponding to particular educational themes and subjects. This information can also be modified and updated to ensure that adequate and challenging learning materials are available for the game participants, and which they encounter during the game.

While it is envisioned that the particular themes and knowledge materials that a participant is exposed to are predetermined, based on the participants actual knowledge and progress within a class, for example, the educational materials a participant is exposed to can also be randomly or pseudo-randomly determined so as to provide a less predictive and more spontaneous game experience.

While the foregoing example of the computing system shows particular modules contained within only the computing system, it will also be appreciated that the remote systems 120 can also include any combination of the modules 140, 150, 160 and 170 contained by the client 110, including the game interface module 140, the character assignment module

150, the communications module 160 and the reporting module 170, as well as any additional modules necessary to implement the methods described herein.

Game Play

Figure 2:
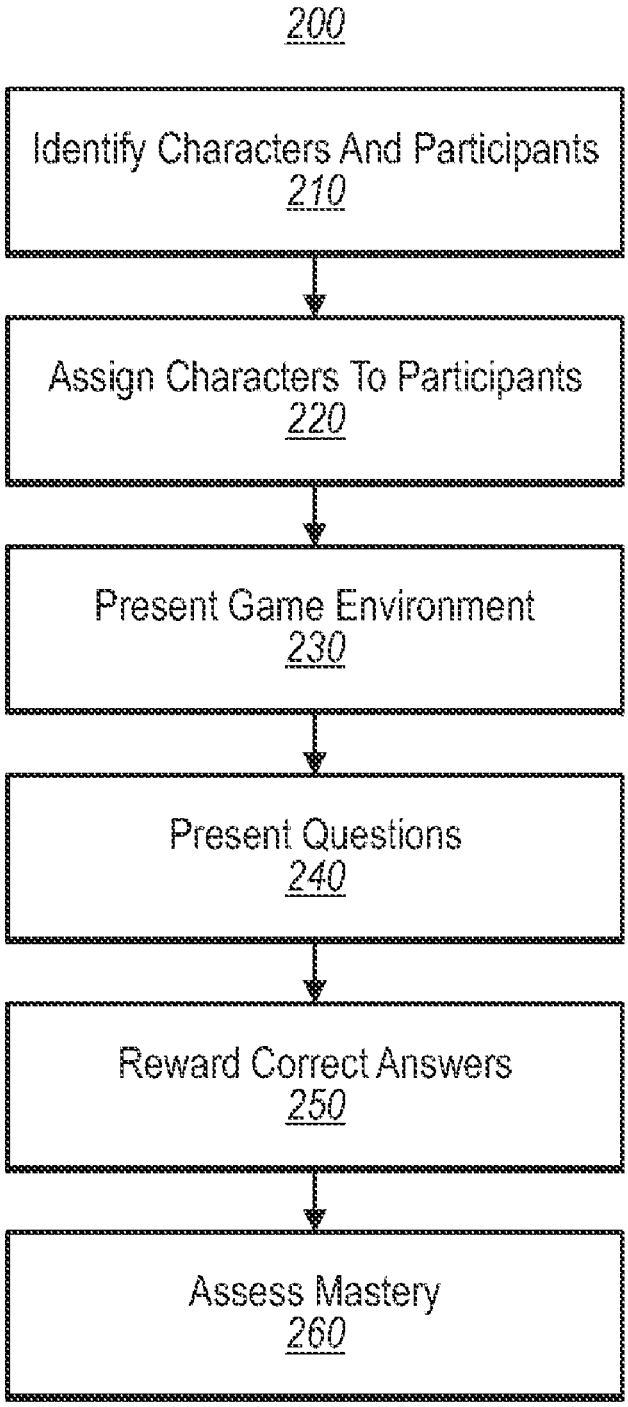
FIG. 2 illustrates a flowchart of acts that are executed during certain embodiments of the invention.

Attention will now be directed to FIG. 2 which illustrates a flowchart containing various acts can be implemented by any combination of human moderators, game participants, client systems 110 and remote systems 120 to practice aspects of the claimed embodiments.

The first illustrated act corresponds to the identification of characters and participants for a game (act 210). The characters for the game and their corresponding attributes can be identified (act 210) in various ways. In some instances, the characters and their attributes are predefined and unalterable. In other embodiments, the game participants and/or moderators help to create or define the characters and their attributes.

Once the characters are defined, they are presented to the user through any desired combination of computer interfaces, textual descriptions and oral descriptions. In some instances, for example, the game participants are presented with a chart, cards, text or materials that define different characters and their attributes. Two dimensional images and three dimensional objects can also be associated with the characters and referenced by the participants in the assignment process. Images and models of the characters are is particularly useful in embodiments in which the game environment is presented on a computer interface or a physical game board.

In some embodiments, the characters are categorized based on type, species, classification, mastery level, or other category. One non-limiting example of identifying and presenting characters will now be provided in which characters are categorized by choice and class. A Character Choice Table, Table 1, is first provided to illustrate some non-limiting examples of character choices that correspond to species. A Character Class Table, Table II, will also be provided to illustrate some non-limiting examples of character classes that correspond to professions or roles.

TABLE I (CHARACTER CHOICE TABLE):

| Character Choice | Character Choice Description |
|---|---|
| WOLF | The wolf is a stealthy species, quiet, calculating, and wise. The wolf tends to run in packs only because he is intelligent enough to realize the benefits of pack hunting. The wolf can also operate as an individual adequately enough, and does so when it is in his best interest. |
| CROW | The crow is also an intelligent species, primarily interested in its own profit. They often prey on others, although some crows have been known to develop differently than their kind, becoming selfless rather than vulturous, choosing to help rather than prey. The crow is a fierce but patient hunter. |
| CHAMELEON | The chameleon is a sly, clever species, capable of changing shape and color to imitate his surroundings. The chameleon rarely chooses outright confrontation, preferring subtlety to aggression. It is a mistake, however, to underestimate the power of the chameleon. |
| DRAGON | The dragon is the boldest of all species, renowned for his ferocity and battle prowess. His sheer strength and size make him a force to be reckoned with. Little can withstand the will of a dragon. |

TABLE II (CHARACTER CLASS TABLE):

| Character Class | Character Class Description |
|---|---|
| Shaman | A Shaman is a healer, interested in the welfare of others, and a very valuable member for any army due to his/her healing powers. A Shaman can heal wounded during battles with the use of medicaments purchased from the PX. Only Level 4 Shamans can revive a fully dead individual with the appropriate card, again purchased from PX. To attain status as a Shaman, a student should pursue citizenship and community related activities. Status points must be negotiated and contracted with the teacher. A Level 1 Shaman can only function in the capacity of Warrior, but through training and experience, can slowly advance from Level to Level and learn the skills to heal wounds inflicted by Archers, non-fatal wounds inflicted in close combat, and eventually, revive fully dead comrades. Because Shamans are primarily interested in the well being of others, they can also negotiate treaties, achieve neutrality, etc. Wolves and Crows are most likely to become Shamans. |
| Merlin | A Merlin is akin to a wizard and is skilled in the use of magic and illusion. Only Merlins can use spells purchased from the PX, and only in a manner consistent with their current Level. To achieve Merlin status, students must research on related fields in English and History, analyze relevant mythologies, and assist in the construction of a classroom mythology. Merlins are valuable members of any army and are equally likely to emerge from every character species, although, as an innately magical species, Dragons will often attain Merlin distinction. |
| Shadow | The Shadow class is one of the most secretive sects. They are incredible fighters, especially in close quarters and capable of administering lethal, stealthy hits on marked targets outside of Battle. To access this elusive group, students must rigorously train their minds and bodies through intense study and discipline. Only the purest of purpose can advance to Level 4 status. Students can achieve status as a Shadow though research on related/relevant academic studies into historical precedent, current events, etc. Lower level Shadows can only target smaller, perceivably vulnerable targets and earn experience via battle opportunity and number of successful solitary "hits." They cannot "mark" commanders of armies with 3 or more until they have earned Level 3 or 4 status. Wolves and Chameleons make great Shadows. |
| Monk | A Monk studies religion and philosophy, and, although automatically equipped with default Warrior status, would rather ponder and write than fight. Monks are typically the scribes of any group, and are possessed with secret knowledge and truth. Monks are intimately involved in the construction and interpretation of mythologies. Wolves and reformed Crows make great Monks. |
| Archer | The Archer is a highly useful class in battle. Archers are able to purchase Longbows and Arrows for use in inflicting premature damage on an opposing army. Training for Archer status requires "long-shot" projects targeting ideas, concepts, and people beyond the classroom walls. Because of its usefulness and relative ease in acquisition, many characters will achieve Archer status in addition to other class distinctions. An Archer's number of Arrow questions fired will be based on level, and the Archer can only be combated by other Archers, specialized Merlin spells, focused Rasputin operations, and the healing powers of Shamans. Lower level Archers can only injure and not kill, making the Shaman a desired defense. |
| Rasputin | A Rasputin is a specialized class skilled in subterfuge. Characters pursuing Rasputin status would be required to do extensive research on the historical importance of such figures as well as plan and execute incendiary operations as negotiated with the teacher. The value of the Rasputin would be in covert ops such as espionage, orchestrating strategic dysfunction, accessorial looting, etc. All character species can attain this class, although Chameleons seem to be the most adept. |
| Jester | A Jester is a highly sought after commodity because of his or her bility to entertain. Skilled Jesters a |

TABLE II-continued (CHARACTER CLASS TABLE):

| Character Class | Character Class Description |
|---|---|
| | know the difference between what is funny and what is not. The Jester class is comprised of serious students of comic relief who make their laughs an academic study. The Jester has no special weapon for battle and must rely on his or her default Warrior status. |
| Warrior | Although a default class, the Warrior is a reputable figure. The Warrior knows how to get things done efficiently and is essential to every army. Warriors will often accumulate immense wealth and prestige. Dragon Warriors are fierce to behold! |

It will be appreciated that the foregoing examples of characters and character types are non-limiting. In particular, there are various types of characters and attributes that can be described beyond those shown above. Images and objects associated with the physical appearance of the characters can also be included in any description and presentation of the characters.

Furthermore, although the foregoing example is directed to a fantasy genre, characters can also be provided for other genres, including modern and real genres corresponding to sports, education, work, city life, children, nature and so forth.

The identification of characters (act 210) can also include the identification of their attributes, including character attack attributes and defense attributes. The identification of attack and defense attributes can be helpful in enabling a participant to select a character based on a perceived benefit to a group that includes the character or that provides a perceived advantage in obtaining a desired result within the game environment.

The following table, Table III, provides one non-limiting example of attack attributes and defense attributes that are generally described and associated with different types of characters. In this example, different attributes are associated with different levels for each character.

TABLE III (CHARACTER ATTACK AND DEFENSE ATTRIBUTE TABLE):

| Character Class | Level 1 | Level 2 | Level 3 | Level 4 |
|---|---|---|---|---|
| Shaman | Healer in training. No substantial skills in healing. Default Level 1 Warrior status | Healing powers limited to injuries inflicted by Level 2 Archers and minor injuries incurred in battle situations | Can heal all non-fatal injuries inflicted in battle situations. | Advanced healer capable of healing all types of injuries, including, at times, even death. Optional neutral status. |
| Merlin | Wizard in training. Extremely limited abilities, Level 1 spells. Default Level 1 Warrior status. | Limited abilities in battle. Can use Levels 1-2 spells. | Skilled in the use of spells for attack and defense, Levels 1-3 | Highly skilled in the use of spells for attack and defense, Levels 1-4, purchasable in the PX. |
| Shadow | Focused on learning discipline and mental acuteness. Default Level 1 Warrior status. | Participate in secret practice sessions with a Master to learn the Shadow arts | Field training of secret Shadow arts. | Master of Shadow arts. Extremely effective in close combat scenarios with specialized attacks and defense. Excellent asset to any army. |
| Monk | Student of religion/ philosophy. Novice in ability to discern truth. Scribe - taker of notes. Default Warrior status | Scribe. Continue studies in philosophy and mythology. Work on constructing classroom mythology. Default Warrior status. | Scribe. Knowledgeable in studies. Advanced construction of classroom mythology. Default Warrior status. | Extremely knowledgeable in mythologies, belief systems, legend, lore, and artifacts. Useful in the search of hidden meanings/ knowledge. Default Warrior status. |
| Archer | Specialized Class. Begin training by taking on "long-shot" assignments outside of class/school. Default Warrior status. Purchase Longbow. | Level 2 Archer continues with "long-shot" tasks. Archery practice for battle. Limited to single shot per battle. | Accurate marksman. Can injure but not kill enemies from distance. Limited to two shots per battle. | Highly accurate marksman, potent in battle. Can deal death blows to foe from distance. No limit to shots fired. |

TABLE III-continued (CHARACTER ATTACK AND DEFENSE ATTRIBUTE TABLE):

| Character Class | Level 1 | Level 2 | Level 3 | Level 4 |
|---|---|---|---|---|
| Rasputin | First Level training begins with academic research into villainous characters from history. Default Warrior status. | Continue research. Begin drafting own plans. Train by planning and initiating small scale operations. Field practice. | Can infiltrate other groups. Spy, subvert order, orchestrate mutinies, etc if skillful enough. Additional looting rights up to $20. | Highly advanced in subterfuge including additional looting rights up to $50 with valid card purchased from the PX. |
| Warrior | Basic attack and defense skills. Only little wealth to purchase goods. Default status for all other classes in training. | Accumulating more wealth for purchase of weaponry in PX. | Position of responsibility and power. Substantial wealth and influence. Well equipped with armor and weaponry. Can take P.O.W.'s if in command. | Master of weaponry. Wealthy and powerful fighter. Often the commander of armies. Can take P.O.W.'s if in command. |

The following table, Table IV, provides another non-limiting example of attack attributes and defense attributes that are associated with different types of characters. In this following example, specific weapons and other items associated with different characters help to define the attack and defense attributes of those characters. In this example, different attack weapons (O) and defensive weapons (D) are available for different characters based on the skill levels or encumbrances (E) of the different characters.

In order for a character within the game environment to purchase or use any of the recited items, the game participant may be required to ask or answer a question correctly, as defined in more detail below.

As shown in Table III, there are different types of questions that correspond to the different items and character attributes.

TABLE IV (CHARACTER ATTACK AND DEFENSE ATTRIBUTE TABLE):

| FIGHTER | Knight | Martial Artist | Commando |
|---|---|---|---|
| Level One - True/False Question-E2 | | | |
| Offense | O-1 | O-1 | O-1 |
| E-1 | Blunted Sword | Jab | B-B Gun |
| Defense | D-1 | D-1 | D-1 |
| E-1 | Tunic | White Belt | Headband |
| Level 2 - Multiple Choice Question-E4 | | | |
| Offense | O-2 | O-3 | O-4 |
| E-2 | Short Sword | Kick | Hand Gun |
| Defense | D-4 | D-3 | D-2 |
| E-2 | Chain Mail | Orange Belt | Camouflage |
| Level 3 - Fill-in-the-blank Question-E6 | | | |
| Offense | O-3 | O-5 | O-7 |
| E-3 | Long Sword | Grapple | Rifle |
| Defense | D-7 | D-5 | D-3 |
| E-3 | Chest Plate | Brown Belt | Combat Vest |

TABLE IV-continued (CHARACTER ATTACK AND DEFENSE ATTRIBUTE TABLE):

| | | | |
|---|---|---|---|
| Level 4 - Performance Question-E8 | | | |
| Offense | O-4 | O-7 | O-10 |
| E-4 | Great Sword | Num Chuck | Bazooka |
| Defense | D-10 | D-7 | D-4 |
| E-4 | Full Plate | Black Belt | Kevlar Combo |
| ARCANE CASTERS | Elementalist | Treewalker | Merlin |
| Level One - True/False Question-E2 | | | |
| Offense | O-1 | O-1 | O-1 |
| E-1 | Wand | Twig | Wand |
| Spell | Singe | Mosquito | Singe |
| Defense | D-1 | D-1 | D-1 |
| E-1 | Robe | Robe | Robe |
| Spell | Puddle | Leaf Skin | Puddle |
| Level 2 - Multiple Choice Question-E4 | | | |
| Offense | O-2 | O-3 | O-4 |
| E-2 | Staff | Staff | Staff |
| Spell | Sunburn | Snake | Kindle |
| Defense | D-4 | D-3 | D-2 |
| E-2 | Snowman | Tree skin | Snow |
| Level 3 - Fill-in-the-blank Question-E6 | | | |
| Offense | O-3 | O-5 | O-7 |
| E-3 | Orb | Stone | Orb |
| Spell | Torch | Wolverine | Fireball |
| Defense | D-7 | D-5 | D-3 |
| E-3 | Igloo | Stone skin | Ice |
| Level 4 - Performance Question-E8 | | | |
| Offense | O-4 | O-7 | O-10 |
| E-4 | Orb Staff | Stone Staff | Orb Staff |
| Spell | Kindle | Bear | Inferno |
| Defense | D-10 | D-7 | D-4 |
| E-4 | Moat | Nature Skin | Snowman |

TABLE IV-continued (CHARACTER ATTACK AND DEFENSE ATTRIBUTE TABLE):

| HEALER | Medic | Inquisitor | Shaman |
|---|---|---|---|
| Level One - True/False Question-E2 | | | |
| Offense E-1 | O-1 B-B gun | O-1 Headache | O-1 Rash |
| Defense E-1 | D-1 Bandaid | D-1 Robe | D-1 Tea |
| Level 2 - Multiple Choice Question-E4 | | | |
| Offense E-2 | O-2 Tranquilizer Gun | O-3 Migraine | O-4 Cold |
| Defense E-2 | D-4 Salve | D-3 Cowl | D-2 Tincture |
| Level 3 - Fill-in-the-blank Question-E6 | | | |
| Offense E-3 | O-3 Hand Gun | O-5 Delusion | O-7 Flu |
| Defense E-3 | D-7 Gauze Strip | D-5 Chainmail | D-3 Vial (Health) |
| Level 4 - Performance Question-E8 | | | |
| Offense E-4 | O-4 Rifle | O-7 Breakdown | O-10 Pox |
| Defense E-4 | D-10 First-Aid Kit | D-7 Shield-Chainmail | D-4 Potion (Health) |
| **STEALTH** | **Rasputin** | **Ranger** | **Shadow** |
| Level One - True/False Question-E2 | | | |
| Offense E-1 | O-1 Wrist Rocket | O-1 Wrist Rocket | O-1 Wrist Rocket |
| Defense E-1 | D-1 Tunic | D-1 Tunic | D-1 Tunic |
| Level 2 - Multiple Choice Question-E4 | | | |
| Offense E-2 | O-2 Throwing Cards | O-3 Short Bow | O-4 Dagger |
| Defense E-2 | D-4 Mask | D-3 Cowl | D-2 Camo |
| Level 3 - Fill-in-the-blank Question-E6 | | | |
| Offense E-3 | O-3 Darts | O-5 Long Bow | O-7 Sniper Rifle |
| Defense E-3 | D-7 Cloak | D-5 Boots | D-3 Cowl |
| Level 4 - Performance Question-E8 | | | |
| Offense E-4 | O-4 Dagger | O-7 Crossbow | O-10 Poison |
| Defense E-4 | D-10 Impersonation-Rats | D-7 Cloak | D-4 Mask |

Notwithstanding the specificity of the foregoing examples, it will be appreciated that there are many other formats for identifying and defining characters, along with their unique attributes, including printed manuals, cards, pamphlets, and other materials, computer displays, oral descriptions and so forth.

As mentioned above, each game participant is assigned one or more characters (act 220). Any suitable means can be used for assigning the characters to the participants, including, but not limited to any combination of moderator instructions, default rules, profile, by affinity, by random selection (as determined by the roll of a dice, selection of a card, etc.), and so forth. One example of a means for assigning characters is the use of profiling surveys and questionnaires to identify and map participant profiles/attributes to character profiles/attributes.

The assignment of characters based on profile matching and/or a participant's affinity for a character can be particularly beneficial for encouraging social groupings and interactions between participants having disparate personality types and demographic backgrounds. Careful mapping and modeling of character attributes to different personality types can also encourage diverse social groupings and participant interactions as the participants' characters are forced to interact within the game environment.

The assignments of characters can also be based at least in part on the perceived or actual mastery of particular educational materials. In particular, certain classes and characters can be limited to game participants having particular proficiency or lack of proficiency in certain educational materials.

To facilitate in the selection and assignment of characters (act 220), various profiling and questionnaires can be used. Some of the questions that can be asked of the participant, for example, can include questions corresponding to self-described personality traits, likes, dislikes, demographic information, and so forth. The following table, Table V, illustrates one non-limiting example of a profiling survey. In this survey, participants are asked to select every entry that describes the participant.

TABLE V (PROFILING SURVEY TABLE):

| X | SELECT ALL THAT APPLY WITH AN X |
|---|---|
| | Sits in the front of class |
| | Sits in the back of class |
| | Student of history |
| | The past is the past |
| | Gets good grades |
| | Has difficulty doing homework |
| | Plays with people's minds/emotions |
| | Enjoys riddles, puzzles |
| | Leader of the pack |
| | Would rather follow |

It will be appreciated that the analysis and matching of profiles between the participants and characters can occur automatically in response to profiling input entered into a computer as well as manually, in response to examining profiling data. Matching of profiles can also be based on participant and moderator discretion.

After or before the characters are assigned, the game participants are introduced to the game environment (act 230). The game environment, as described above, can include any of the storylines, character interactions, and resources corresponding to the characters, entities and other objects and items referenced in the game. In some instances, the game environment is merely conceptual. In other instances, the game environment includes at least some images, text or three dimensional models that can be viewed and referenced.

In other embodiments, the game environment is visual, aural and/or tactile, such as when it is generated and displayed on a game board or through one or more computer interfaces. In one embodiment, these computer interfaces are generated by software running on one or more computing systems, such as, for example, the client system 110 or remote systems 120 described above in FIG. 1.

The game environment may also include rules 192, character materials 194 (e.g., images, descriptions, models, cards, and so forth), as well as any other game materials 196, such as a game board, dice, spinner, map, storyline descriptions, moderator instructions, illustrations, cards, as well as any physical means for assigning the characters to the game participants (e.g., character descriptions, rules, guidelines, surveys, questionnaires, dice, spinners, etc.), and so forth.

As the game is played, each participant's character will participate in various game activities, including one or more game actions. It will be appreciated that virtually any type of action or activity can be encountered within the game environment, as defined by the rules and guidelines of the game or as dictated by a game moderator.

Some non-limiting examples of actions or activities that can involve a character within the game environment include (a) developing a code of conduct and a personal coat of arms, (b) swearing an oath of honor and virtue, (c) initiate quests, (d) encounter and defeat a foe, (e) assist another in distress, (f) join a group or army, (g) lead a group or army in battle, (h) purchase items of value, (i) develop skill, (o) advance a character level, (p) modify a character attribute, (q), obtain a possession, (r) interact with another character, (s) design and initiate feats, (t) learn and/or master particular educational subject matter. In fact, virtually any contemplated activity or action can be incorporated into the game environment and storyline of the present invention.

One reoccurring activity within some embodiments is battle, where the participant's character battles with one or more other characters and entities. The battle can be voluntarily, such as when the character initiates the battle or attack, or involuntary, such as when the character is attacked.

A battle consists of sequences in which each character or group of characters in the battle take turns attacking the opponent(s) in the form of a question (and/or a twitch sequence) and then conducting a strategic defense to a received blow by answering a question posed by the opponent(s) (and/or by initiating a particular twitch sequence). Victory in battle is determined when one character or team sufficiently damages or destroys their opponent(s). The damage of each attack during a battle is based on a predetermined combination of the battling characters' attributes, including attack and defense attributes, the type of question presented with the attack (act 240) and the answer given in response to the question (act 250). In some embodiments, victory requires at least some battle twitch sequences.

Typically, a character successfully deflects or shields against the damage of an attack by providing a correct answer to a presented question. Different levels of accuracy and quality in the answer provided can be considered (automatically and/or by a moderator) to determine the success of the defense and the actual damage to a character or group resulting from the battle sequences.

In some embodiments, the questions asked of a participant during battle or during another game action correspond to educational materials that are contextually unrelated to the game environment, game action, or game storyline. In other embodiments, the presented questions are contextually related to the game environment or a game action. Such embodiments may include, for example embodiments in which game environments and game actions that are modeled after particular training duties and training materials and that have been incorporated into the game environment. It will also be appreciated that combinations of contextually related and unrelated questions corresponding to a plurality of different subjects can be presented to accommodate virtually any need and preference.

In some embodiments, government mandated scholastic tests are presented to students through the game as the students battle or interact with other characters and entities within the game environment. For example, a 'big boss' or quest may correspond to a school or state mandated test. The participant will be asked questions from the mandated test as the participant's character progresses through the quest or battles the 'big boss'. The successful completion of the test, as determined by satisfying predetermined standards, will result in a commensurate reward within the game environment.

To facilitate such embodiments, such as those described above with regard to testing, the game provides an interface that can be accessed by an instructor and which is provided for receiving sets of questions corresponding to particular themes or tests. The instructor can entered any number of questions corresponding to any subject matter. These questions will be automatically presented during the game in a predetermined, random and/or pseudo-random manner during the game and depending on the circumstances in which the participant finds themselves within the game.

Notwithstanding the foregoing description of battles, it will be appreciated that battles and combat actions are not required in all embodiments of the present invention to successfully present and test educational materials. In fact, for participants and users that do not want to engage in hypothetical actions that resembles a violent action, game environments can be created that replace combat and battle actions with non-violent actions, such as obtaining possessions, performing a feat, and so forth.

The rewards for correctly answering questions (act 250) can also include rewards other than victory in battle. For example, a character within the game environment can obtain other rewards for correctly answering questions too, including a possession, a character attribute, the successful completion of a task or level, money, food, or any other reward.

Figure 3:
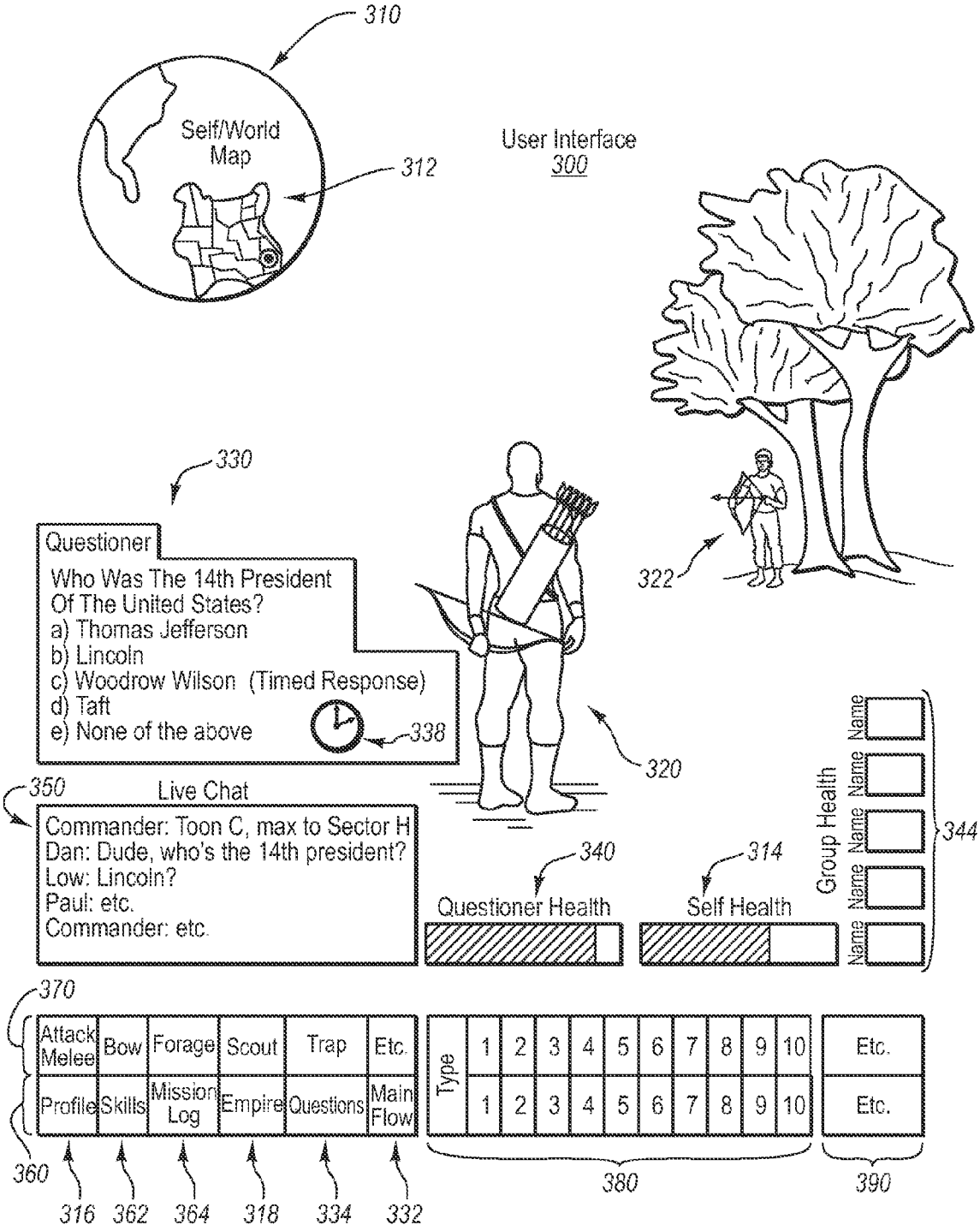
FIG. 3 illustrates one embodiment of a game interface through which a battle sequence can occur.
Figure 1:
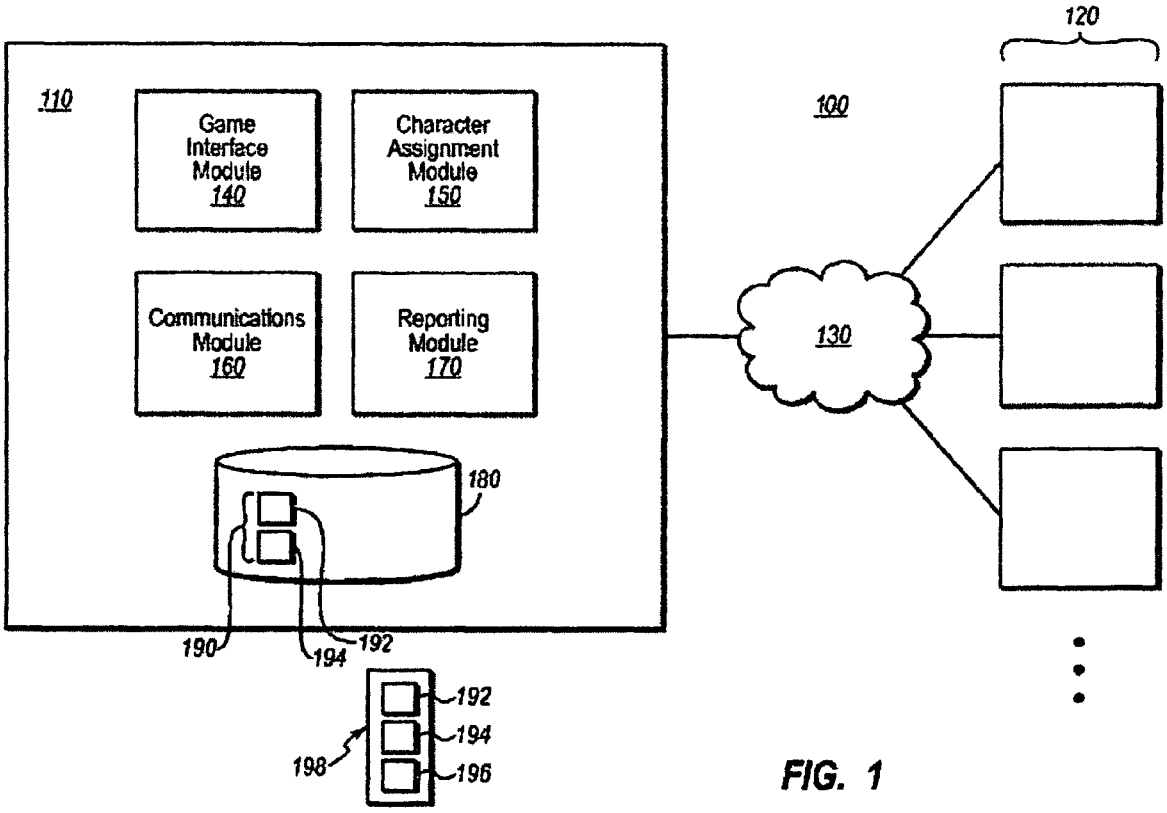

In some embodiments, the actual mastery of a particular subject matter, as evinced by particular and successful sequences within the game (such as, but not limited to battle sequences), result in the characters of the game obtaining ownership of particular states or knowledge territories. This embodiment is particularly useful for enabling the participant or supervisor to view a map showing how much of a participant has mastered of a particular world of knowledge. FIG. 3 illustrates one embodiment of a world 310 having various territories 312 that can be owned through mastery of particular subject matter and/or through progression through a game. It will be appreciated that although the world 310 in FIG. 3 appears to be an actual world, other worlds of knowledge can correspond to particular regions or theoretical spaces that do not directly relate to a round and physical world.

It will also be appreciated that although rewards are typically good, certain rewards received within the scope of the present invention can include a negative reward as a consequence, for example, when the participant fails to answer a question correctly.

The foregoing examples have been provided with specific regard to the presentation of questions and answers. It will be appreciated, however, that particular behavior of a participant can also result in the application of a reward to the participant's character within the game environment. For example, a student's attendance or completion of a project or assignment can also result in the application of an award to the student's character within the game environment. Similarly, an absence, a tardy, bad behavior and other performances can also result in the application of a negative reward or consequence for the student's character. Various interfaces are provided for the instructor/moderator/participant to award certain items or to enable certain aspects of the game (e.g., portals) in response to certain real world activities.

According to some embodiments of the invention, a participant's mastery of the educational materials presented during a game can be assessed by evaluating a status or condition of the participant's character within the game environment. (act 260). These status and condition measures can be reflected, for example, through the world map 310, empire status 318, profile 316, health 314 and other similar interface objects. Each of these will be described in more detail below with reference to FIG. 3.

As a participant plays the game and answers questions about the educational materials that are presented, the participant's character will advance through a storyline, interact with other entities and objects, and develop character's attributes. The participant's mastery of the educational materials can therefore be assessed by evaluating and measuring the success and failures of the participant's character within the storyline. A character's developed attributes, skill levels, titles, possessions and progress though a storyline can also be measured and used to identify a grade or score corresponding to the participant's mastery of the educational materials.

Using games of the invention to present and test educational materials that correspond to a school curriculum can be particularly beneficial when the students do not necessarily care about their academic grades and when the students have a difficult time interacting with others. In particular, a student's interest in playing interactive games, developing game characters and engaging in hypothetical battles within a game environment can be used as a motivator for the students to study and learn desired content. The methods and systems of the present invention can also help encourage social interaction of diverse groups of students as the students' characters interact within the game environment.

In some embodiments, the methods of the invention also include requiring a participant with one type of character to recruit other participants with other types of characters to develop a well-rounded or diverse group that is capable of accomplishing tasks encountered during game play. Group diversification can also be beneficial during battle, inasmuch as different attributes of different group members can be leveraged to provide flexibility in the attacks and maneuvers during a battle. Sometimes participants can also be forced to transition/evolve or switch their characters into other characters, as required by a game storyline or moderator.

Embodiments requiring recruiting of group members are particularly beneficial for building the self-esteem and confidence of socially challenged participants as they feel valued, during the recruiting process. In particular, this is a way for some participants to feel as though their skill sets are important and since they are able to make a measured contribution to a particular group during game play.

In summary, the application and testing of educational materials with games, according to the present invention, can promote a heightened interest and attention in learning and can help remove some of the social barriers created by cliques. The present invention can also enable game participants to leverage and utilize their special knowledge of playing other games, particularly other role-playing type games.

The present invention is also particularly beneficial for motivating students to learn additional materials, beyond the minimum requirements mandated by the government, as the students will want to obtain a strategic advantage within the game environment.

The motivation for learning can come in different ways. Some students, for example, will feel a motivation to win battles, while other students will feel motivated to develop their game characters and to obtain certain possessions. Other students will also feel a desire to explore uncharted and unconquered areas of a map. Regardless of the reasons, it will be appreciated that the present invention can be utilize to present and test educational materials in such a fun and interactive way that it can compete for the interests and attentions of a student.

One of the various game interfaces and methods for presenting and testing educational materials will now be specifically identified and described in reference to FIG. 3.

As shown, a user interface 300 is provided that includes a world map 310, and various other interface features that will now be described. The participant's character 320 is shown in the present embodiment with at least one other game character 322. This other game character 322 can be the character of another participant or the character of a Boss, for example, which presents questions to the target character 320. The target character 320 answers questions to defend or attack in a battle sequence, as described above.

The questions exposed to a participant during the game can be presented through a question interface in various formats. Initially, the question interface can be presented in various formats (e.g., as a pop-up, a pull-down, or permanent display). The format of the questions presented within the interface can also vary significantly (e.g., multiple choice, true/false, fill in the blank, essay and so forth). When essay questions are presented, writing analysis software can be used to identify writing patterns and content that will be evaluated to determine how good of an answer is provided.

When the questions presented to the participants are crafted by other participants, the other participants can enter their questions through one or more templates available through the question interface 300 or another menu interface, such as the main menu interface 332 and/or the questions menu option 334.

As shown, the questions interface 330 includes a clock 338 for measuring a time period for responding to a question. The particular format of the clock 338 is not important. In fact, in some embodiments a clock is not even presented. When a clock 338 is presented, the participant may be required to answer the presented question correctly within a predetermined period of time in order to get credit for answering the question. In other embodiments, the faster the participant answers a question, the more credit the participant gets. This credit can be realized by providing a better result for the participant during the battle sequences (e.g., defend and attack).

In other embodiments, the clock 338 reflects a total amount of time (e.g., one or two hours, or any other period of time) allocated to the participant for answering a plurality of questions, such as, for example, corresponding to a test being administered during a battle with a Boss or the questioner 322.

Depending on the success of the battle sequences, the target's 320 and questioner's health will be affected. The cumulative affect of a battle sequence or a plurality of battle sequences can be reflected in one or more status bars, such as the target health status bar 340 or the self health status bar 314. Various other health or status bars 344 can also be presented for viewing the health of other game participants and group members. These status bars 344, 340 and 314 can be presented automatically, as pop-ups, when appropriate, and/or on demand, such as through the main menu 332 or profile 316 menu options.

In game scenarios incorporating group play, a live chat dialog box 350 can be presented for enabling interactive communication between group members and for enabling group participation in answering the questions.

The menu options 360 shown at the bottom right portion of the interface 300 include a profile menu option 316, a skills menu option 362, a mission log menu option 364, an empire menu option 318, a questions menu option 334, and a main menu option 332. Some of these menu options, which can each be selected for viewing a more detained and corresponding interface, will now be described in more detail.

The profile menu option 316, when selected, presents a screen interface with various personal profile information. This personal profile information can include any combination of profile information, such as personal name and identification information, character or participant ranking information, status, title(s), classification and type. Similar group information can also be provided. The profile interface can also display a list of inventory items (e.g., weapons, tools, skills, and so forth), along with statistics and experience metrics.

The skills menu option 362, when selected, presents an interface that shows various skills owned or accessible to the participant/group character(s). These skills can correspond to real world skills, such as job skills or special knowledge. These skills can also correspond to the skills and abilities of the participant's character(s) within the game, such as, but not limited to, spells and so forth.

The mission log menu option 364, when selected, presents an interface that shows a listing of quests that are available for a particular learning/training curriculum and rewards available for completing the quests. In some embodiments the menu log interface shows which quests have been completed by the participant, or a group of participants.

The empire menu option 362, when selected, presents an interface that shows a detailed listing and/or map of controlled zones, resources and items relevant to a participant's game empire. The empire interface can also show which zones are in conflict, when two or more participants or game characters are competing for the same zone(s). Empire evolution can also be reflected in the empire interface, to show the measured development of a technology, building or characters within an Empire. For example, in embodiments that include the evolution of buildings and civilizations, the empire interface can reflect the current status of the evolved game elements.

Although many of the embodiments described above refer to empire building with the inference, or at least the context of exclusive empire domination (e.g, each territory can have only one owner and wherein different participants compete for the same resources), it will be appreciated that there are many embodiments that include mutual and shared empire building. In the shared and mutual empire building embodiments, a plurality of different participants can each own a common territory within the game. This can be reflected, for example, when each participant posts their flag within the same territory.

Within the empire interface, selectable options enable the participant to view their empire, their group's empire and the empire of other participants. It will be appreciated that the visual representation of a mapped empire can directly correspond to special training/educational accomplishments and strengths of the various participants.

The questions menu option 334, when selected, presents an interface for selecting and creating questions to present in the game environment. In some embodiments, the questions interface is linked to and accesses a database of questions available for player selection, such as the questions input by an instructor or moderator. These questions can also be entered by or made accessible through a third party or clearinghouse. In some embodiments, the participants are only able to select and use certain questions, based on question type or subject matter, according to the character's attributes and/or according to participant mastery of certain knowledge. The type of game event being engaged, either thematically (based on subject matter) or activity within the game (e.g., battle, stealing, and so forth). The mastery of certain knowledge can be certified by a moderator, or automatically determined based on the character's attributes and measured progression through a game.

Although many of the embodiments described in this application relate to the presentation and testing of educational materials through battle sequences and other events requiring the asking and answering of questions, it will be appreciated that various game events can also include twitch sequences that are unrelated to any special knowledge (other than how to operate a controller).

The twitch sequences can be relied upon, for example, in having a character navigate through a map. Certain movements, even those related to battle sequences, can also rely partially or entirely on twitch sequences and controls. The percentage of twitch sequences integrated into a game can be varied with user input to accommodate virtually any desired preference or need.

The main menu option 332, when selected, presents an interface to any of the above described interfaces or any other interfaces required to implement the methods of the present invention.

Some of the other displayed options 370 correspond to particular activities or attack types. The available options 370 can vary according to the type of character being used as sell as the type of event occurring within the game at a particular moment.

Various hot keys 380 can also be provided, as well as other interface elements 390 to facilitate game play. The particular formation and functionality of these other hot keys 380 and elements 390 is not important and can be modified to accommodate different needs and preferences.

Although interface 300 generally corresponds with a battle type sequence, it will be appreciated that many events and activities of the game are not directly related to any particular battle sequence. These safe zones or battle-free activities can be encountered automatically as part of a game storyline or in response to a participant having their character enter a safe zone through a portal.

Portals, as mentioned above, can lead to different thematic worlds, events or genres where different knowledge is tested and/or learned. For example, a character in the fantasy/middle-ages genre can enter a job training industry world/genre by entering a portal to that new world. In another embodiment, a character in a civil war world/genre can be transported to an American v. Mexican war world/genre. The game can be modified to accommodate virtually any quantity and type of worlds or genres, which can each be accessed through the portals.

The portals can be presented in designated or random locations within the game and/or in response to receiving input from a participant (e.g., via menu navigation). According to some embodiments, the worlds that can be entered through the portals present different sets and/or types of learning materials than those presented in alternate worlds.

In each genre/world, the educational materials, characters, tools, rewards, and events can be closely modeled after that particular genre/world where a character is located so as to facilitate and reinforce the learning that is taking place. This is particularly beneficial when the genre relates to a particular region or people having a unique language. In particular, the questions and answers presented to the game participants can be dynamically modified to the particular language corresponding to the genre/worlds where the participant's character is located or through which the participant's character passes.

In some embodiments, safe zones, such as libraries or other safe zones are accessible through the portals where learning can take place without any battle sequences or where only mock training battle sequences occur. A participant may want to enter such a safe zone, for example, to master new subject matter for use in a subsequent game event.

The safe zones can also be locations where a participant is presented class or training materials. These materials can be presented in a contextually relevant or irrelevant manner. For example, a contextually relevant discourse or debriefing might be presented by General Patton regarding WWII. Contextually relevant presentation of materials can sometimes help retain the interests of the participants.

The game environment can also be customized and modified at any time to accommodate virtually any curriculum and educational materials, including, but not limited to mathematics, English or other languages, social studies, history, geography, geology, physics, physical education, job specific materials, school curriculum, and so forth. In this regard, the present invention will be particularly useful in schools applying the new learning theories regarding Individual Education Planning (IEP), wherein the students have the opportunity to learn at their own pace.

Although the foregoing embodiments have been described in language specific to structural features and/or methodological acts, it is to be understood that the subject matter defined in the appended claims is not necessarily limited to the specific features or acts described above, or any particular order for implementing the recited acts. Rather, the specific features and acts described above are disclosed as only examples for some of the claimed embodiments.

In particular, although many of the foregoing examples refer to embodiments for participating in a game that is played with the use of a computing system, the inventive games and methods for playing the games do not necessarily require computers. In some embodiments, for example, the game is a board game in which the players have characters advance around or through portions of the game board. In these embodiments, it will be appreciated that the instruction manuals, rules, cards, pictures, game environment models, character models, charts, dice, spinners and other game board tools all comprise suitable means for implementing the acts described above, including the acts recited in reference to FIG. 2. These game tools also comprise components of the game environment when the game is a board game.

Accordingly, although specific examples have been provided with regard to the embodiments described above, the present invention may be embodied in other specific forms without departing from its spirit or essential characteristics. Accordingly, the described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method implemented in a computing environment for presenting educational materials in a video game environment, the method comprising:

a computing system providing a game interface for displaying game characters, each character comprising corresponding attributes that include at least an attack attribute and a defense attribute, the computing system comprising memory operatively coupled to one or more processors;

assigning a first character to a first human participant;

assigning a second character to a second human participant;

the computing system presenting a game environment within the game interface that involves the first character in a storyline and that includes game actions that the first character participates in, wherein the first human participant is presented with educational materials corresponding to a first subject matter, and wherein the game actions include at least one of modifying the attributes that correspond to the first character, obtaining possessions for the first character and using the first character to interact with at least the second game character;

the computing system presenting questions to the first human participant when the first character participates in a particular game action within the game environment, wherein the presented questions correspond to educational materials of the first subject matter, and wherein at least one question is presented to the first human participant, corresponding to a virtual attack of the first character by the second character within the game environment;

the computing system displaying a first health display element within the game environment that reflects a health status of the first character and that reflects at least a decrease in the health status of the first character as a consequence to damage inflicted by the virtual attack if the first human participant provides an incorrect answer to the at least one question;

the computing system displaying a questions menu option within the game environment to the first human participant with which the first human participant is enabled to select or create one or more questions for use in connection with an offensive virtual attack applied by the first character within the game environment;

the computing system displaying a second health display element that reflects a health status of the second character and that reflects at least a decrease in the health status of the second character in connection with damage inflicted by the offensive virtual attack by the first character within the game environment; and the computing system providing at least one portal within the game interface which, when entered by the first character, transports the first character to a new world where educational materials presented to the first character correspond to a second subject matter that is different than the first subject matter.

2. A method as recited in claim 1, further comprising an act of providing battle sequences within the game environment that include twitch sequences.

3. A method as recited in claim 1, wherein the new world is thematic with a particular educational theme and wherein characters and educational materials encountered within the new world correspond with the particular educational theme.

4. A method as recited in claim 1, wherein the method further includes providing a safe zone within the game environment where the first human participant is presented with educational materials absent any battle sequences.

5. A method as recited in claim 1, further comprising an act of assessing mastery of the educational materials by the first human participant, wherein assessing mastery of the educational materials is based at least in part on answers presented by the first human participant in response to the presented questions.

6. A method as recited in claim 1, wherein the questions presented to the first human participant are contextually unrelated to the storyline involving the first character and the particular game action.

7. A method as recited in claim 1, further comprising:

requiring the first character to join a group of at least one other character within the game interface, and wherein modifying the attributes that correspond to the first character is further dependent upon at least one other participant of the at least one other character in the group providing a correct answer to a question.

8. A method as recited in claim 1, wherein each of the plurality of characters is associated with a personality profile.

9. A method as recited in claim 1, wherein potential damage for each of the virtual attack and offensive virtual attack is based on attributes of the first character, attributes of the second character and a type of question asked and wherein the type of question asked corresponds to a type of a virtual weapon used in the game environment and which is associated directly with the type of question.

10. A method as recited in claim 1, wherein the questions menu option limits the type of question the first human participant can ask from a plurality of questions based on the attributes corresponding to the first character.

11. A method as recited in claim 10, wherein the plurality of questions are entered by a teacher of the first human participant into a database accessible by the game interface.

12. A method as recited in claim 1, wherein the method further includes:

the first character successfully defending the virtual attack within the game environment and avoiding the damage to the first character in response to the first human participant provides an correct answer to the at least one question or, alternatively, the first character receiving damage inflicted by the virtual attack within the game environment in response to the first human participant providing an incorrect answer to the at least one question.

13. A method as recited in claim 1, wherein the educational materials comprise educational materials corresponding to a school curriculum.

14. A method as recited in claim 1, wherein the method further includes displaying the game interface with a question menu display element, a live chat display element, the first character, at least one other character, health status bar elements, and menu options corresponding to at least a character profile, and an empire map.

15. The method recited in claim 1, further comprising:

presenting a first display element comprising a visual display of the first character having particular attack and defensive capabilities;

presenting a second display element comprising a visual display of the second character in battle with the first character;

presenting a question display where questions presented by the second character are displayed for viewing by the first human participant associated with the first character, wherein each question represents a virtual attack by the second character against the first character that is capable of causing damage to the first character.

16. A method as recited in claim 15 and further comprising:

presenting a world map display element, which simultaneously provides a visual representation of a plurality of territories in a world, wherein each of the plurality of territories correspond to different educational subject matter, and wherein the world map reflects which of the plurality of territories and corresponding subject matter the first human participant is considered having successfully mastered, and which of the plurality of territories and corresponding subject matter the first human participant is considered to not have mastered.

17. A method as recited in claim 15, wherein the first character corresponds to a Boss and a test being administered by the second human participant to the first human participant through the video game interface and wherein the questions displayed correspond to test questions.

18. A method as recited in claim 15 and further comprising:

presenting a clock display element showing a total amount of time to answer a plurality of questions.

19. The method as recited in claim 15, wherein the first human participant launches an affirmative virtual attack against the second human participant by posing the selected or created one or more questions to the second human participant, and wherein the second health display element reflects a decrease in the health status of the second character when the second human participant answers the selected or created one or more questions incorrectly.

20. The method of claim 1, wherein the method further includes receiving participant input through the questions menu option corresponding to the offensive virtual attack which is applied to the second character and that is capable of causing damage to the second character when the second human participant assigned to the second character fails to properly respond to a question presented in response to the participant input.

21. A computer program product comprising a non-transitory storage medium for use in a computing system that includes a processor that is capable of executing computer-executable instructions, the computer program product comprising:

one or more non-transitory computer storage medium having computer-executable instructions which implement a method executed by the computing system for presenting educational materials in a video game environment, the method comprising:

the computing system providing a game interface for displaying game characters, each character comprising corresponding attributes that include at least an attack attribute and a defense attribute;

assigning a first character to a first human participant;

assigning a second character to a second human participant;

the computing system presenting a game environment within the game interface that involves the first character in a storyline and that includes game actions that the first character participates in, wherein the first human participant is presented with educational materials corresponding to a first subject matter, and wherein the game actions include at least one of modifying the attributes that correspond to the first character, obtaining possessions for the first character and using the first character to interact with at least the second game character;

the computing system presenting questions to the first human participant when the first character participates in a particular game action within the game environment, wherein the presented questions correspond to educational materials of the first subject matter, and wherein at least one question is presented to the first human participant, corresponding to a virtual attack of the first character by the second character within the game environment;

the computing system displaying a first health display element within the game environment that reflects a health status of the first character and that reflects at least a decrease in the health status of the first character as a consequence to damage inflicted by the virtual attack if the first human participant provides an incorrect answer to the at least one question;

the computing system displaying a questions menu option within the game environment to the first human participant with which the first human participant is enabled to select or create one or more questions for use in connection with an offensive virtual attack applied by the first character within the game environment;

the computing system displaying a second health display element that reflects a health status of the second character and that reflects at least a decrease in the health status of the second character in connection with damage inflicted by the offensive virtual attack by the first character within the game environment; and the computing system providing at least one portal within the game interface which, when entered by the first character, transports the first character to a new world where educational materials presented to the first character correspond to a second subject matter that is different than the first subject matter.

22. A computing system comprising a processor and system memory storing computer-executable instructions which, when executed by the processor, implement a method for presenting educational materials in a video game environment, the method comprising:

the computing system providing a game interface for displaying game characters, each character comprising corresponding attributes that include at least an attack attribute and a defense attribute;

assigning a first character to a first human participant;

assigning a second character to a second human participant;

the computing system presenting a game environment within the game interface that involves the first character in a storyline and that includes game actions that the first character participates in, wherein the first human participant is presented with educational materials corresponding to a first subject matter, and wherein the game actions include at least one of modifying the attributes that correspond to the first character, obtaining possessions for the first character and using the first character to interact with at least the second game character;

the computing system presenting questions to the first human participant when the first character participates in a particular game action within the game environment, wherein the presented questions correspond to educational materials of the first subject matter, and wherein at least one question is presented to the first human participant, corresponding to a virtual attack of the first character by the second character within the game environment;

the computing system displaying a first health display element within the game environment that reflects a health status of the first character and that reflects at least a decrease in the health status of the first character as a consequence to damage inflicted by the virtual attack if the first human participant provides an incorrect answer to the at least one question;

the computing system displaying a questions menu option within the game environment to the first human participant with which the first human participant is enabled to select or create one or more questions for use in connection with an offensive virtual attack applied by the first character within the game environment;

the computing system displaying a second health display element that reflects a health status of the second character and that reflects at least a decrease in the health status of the second character in connection with damage inflicted by the offensive virtual attack by the first character within the game environment; and the computing system providing at least one portal within the game interface which, when entered by the first character, transports the first character to a new world where educational materials presented to the first character correspond to a second subject matter that is different than the first subject matter.

* * * * *

UNITED STATES PATENT AND TRADEMARK OFFICE

CERTIFICATE OF CORRECTION

PATENT NO. : 7,963,835 B2
APPLICATION NO. : 11/686181
DATED : June 21, 2011
INVENTOR(S) : Jessop et al.

It is certified that error appears in the above-identified patent and that said Letters Patent is hereby corrected as shown below:

The Title page;

The Title page, showing the illustrative figure, should be deleted and substitute therefor the attached Title page.

Delete fig. 1 and substitute therefor the drawing sheet, consisting of fig. 1 as shown on the attached page.

Column 4
Line 65, change "invention." to --invention;--

Column 6
Line 16, change "with character" to --with a character--
Line 56, change "participants" to --participant's--

Column 7
Line 20, change "denote fixed" to --denote a fixed--

Column 8
Line 44, change "client storage 118" to --client storage 180--
Line 57, change "participants" to --participant's--

Column 9
Line 7, change "acts can" to --acts that can--
Line 27, change "characters are is particularly" to --characters are particularly--

Column 10
Line 8, change "heal wounded" to --heal the wounded--
Line 35, change "though" to --through--

Signed and Sealed this
First Day of November, 2011

David J. Kappos

David J. Kappos
*Director of the United States Patent and Trademark Office*

Line 67, change “Jesters a” to --Jesters--

Column 17
Lines 30-31, change “voluntarily” to --voluntary--

Column 18
Line 15, change “entered” to --enter--
Line 26, change “resembles” to --resemble--

Column 20
Line 4, change “utilize” to --utilized--
Line 57, change “affect” to --effect--

Column 21
Line 3, change “right” to --left--
Line 4, change “include” to --includes--
Line 33, change “empire menu option 362” to --empire menu option 318--

Column 22
Line 32, change “sell” to --well--

Column 25
Line 36, change “an correct” to --a correct--

(12) United States Patent
Jessop et al.

(10) Patent No.: US 7,963,835 B2
(45) Date of Patent: Jun. 21, 2011

(54) GNOSI GAMES

(76) Inventors: Louis G. Jessop, South Jordan, UT (US); Paul D. Noble, West Jordan, UT (US); Daniel E. Loveridge, Sandy, UT (US)

( * ) Notice: Subject to any disclaimer, the term of this patent is extended or adjusted under 35 U.S.C. 154(b) by 1105 days.

(21) Appl. No.: 11/686,181

(22) Filed: Mar. 14, 2007

(65) Prior Publication Data

US 2008/0009346 A1 Jan. 10, 2008

Related U.S. Application Data

(63) Continuation-in-part of application No. 11/456,179, filed on Jul. 7, 2006, now Pat. No. 7,677,967.

(51) Int. Cl.
*A63F 13/00* (2006.01)

(52) U.S. Cl. ..... 463/9; 434/323

(58) Field of Classification Search ..... 463/9; 434/236
See application file for complete search history.

(56) References Cited

U.S. PATENT DOCUMENTS

2007/0238079 A1 * 10/2007 Harrison ..... 434/236
* cited by examiner

*Primary Examiner* — Melba Bumgarner
*Assistant Examiner* — Thomas H Henry
(74) *Attorney, Agent, or Firm* — Workman Nydegger

(57) ABSTRACT

Educational materials are presented in the format of games such as role-playing where participants progress through game storylines within a game environment. Each game participant is assigned a game character having attributes that can be modified as the character progresses through the game storylines. The character encounters challenges and participates in game actions that require the participant to answer questions corresponding to educational materials that are sometimes contextually unrelated to the game storylines. The character also passes through portals to different worlds that are thematically related to different learning materials and where different learning experiences and testing occurs.

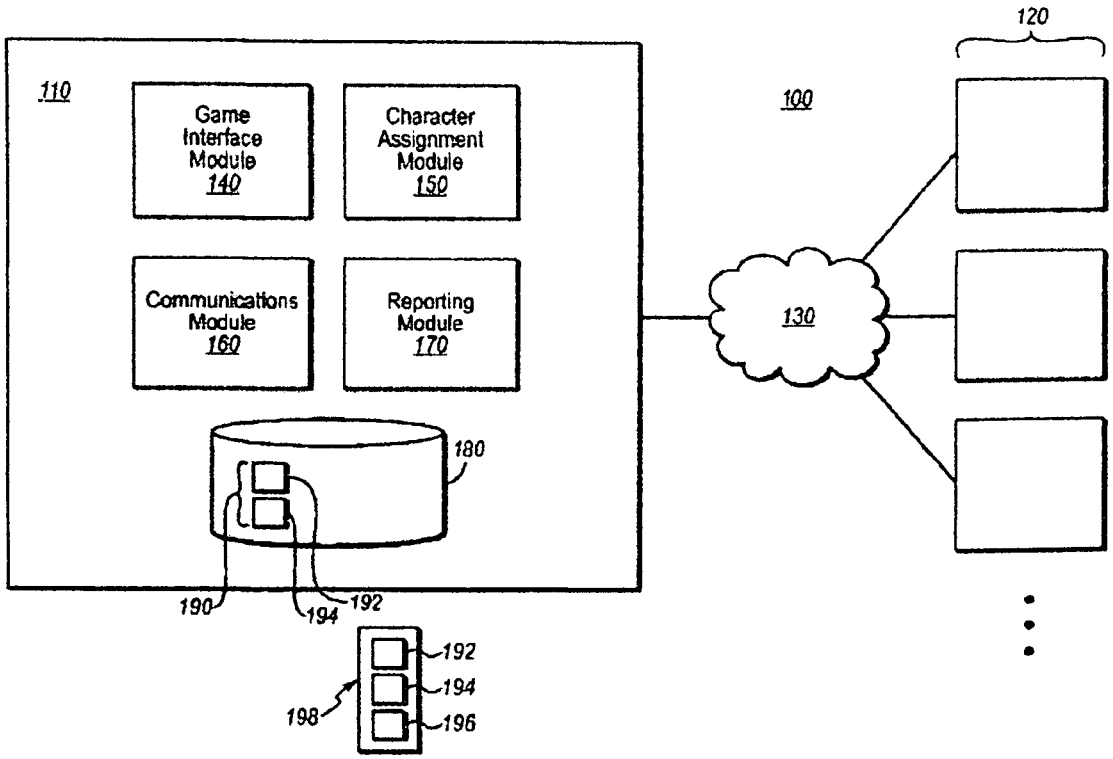

22 Claims, 3 Drawing Sheets